United States Patent [19]

Yao

[11] Patent Number: 4,822,969

[45] Date of Patent: Apr. 18, 1989

[54] APPARATUS FOR CONTINUOUS-DIRECT-RESISTANCE HEATING OF LONG-LENGTH ARTICLES

[75] Inventor: Yugo Yao, Kanagawa, Japan

[73] Assignee: Neturen Company Limited, Tokyo, Japan

[21] Appl. No.: 184,614

[22] Filed: Apr. 21, 1988

[51] Int. Cl.[4] ..... H05B 1/00

[52] U.S. Cl. ..... 219/50; 219/116

[58] Field of Search ..... 219/50, 116

[56] References Cited

U.S. PATENT DOCUMENTS 553,923 2/1896 Lemp ..... 219/116

FOREIGN PATENT DOCUMENTS 71-36485 12/1971 Japan .
80-116064 1/1980 Japan .
718835 11/1954 United Kingdom .

*Primary Examiner*—E. A. Goldberg
*Assistant Examiner*—Melissa C. Chiu
*Attorney, Agent, or Firm*—Wenderoth, Lind & Ponack

[57] ABSTRACT

The present invention relates to an apparatus for continuous-direct-resistance heating of long-length articles wherein the travelling long-length article is made to contact with roll electrodes disposed in a specified spacing, then made to pass through an annular transformer disposed between the roll electrodes.

Conductive members with sufficiently less electrical resistance than that of the long-length article located between the both electrodes are disposed on the periphery of the transformer with the both ends thereof connected to the roll electrode through a slider, thereby a current being induced in the long-length article with the conductive member as the retrace, which heats the long-length article having a higher resistance very efficiently, neither resulting in an external voltage, nor causing electrically any obstacle to the production line in which the apparatus is installed.

The apparatus comprises three roll electrodes, two transformers and conductive members being disposed on the periphery of the transformer connected to the neighboring roll electrode, the power being fed to each transformer from two single-phase transformers in the Scott connection with a three-phase power supply, thus providing heating without developing imbalance in the three-phase voltage.

14 Claims, 7 Drawing Sheets

APPARATUS FOR CONTINUOUS-DIRECT-RESISTANCE HEATING OF LONG-LENGTH ARTICLES

FIELD OF THE INVENTION

The invention relates to an apparatus for heating of long-length articles in strip, wire, bar and the like made of steel, non-ferrous or other conductive materials to a specified temperature according to a variety of applications by direct-resistance heating while causing the said articles to travel continuously.

DESCRIPTION OF THE PRIOR ART

There are two types of the conventional direct-resistance-heating apparatuses which heat the long-length articles while causing them to travel continuously:

The one is an apparatus being used for heating steel wire, bar or the like for the purpose of increasing the strength by means of heat treating including hardening and tempering as disclosed in U.S. Pat. No. 3,929,524 or for heating, for various purposes, of long-length articles in strip, wire bar made of ferrous or non-ferrous me&al wherein the basic arrangements is illustrated in FIG. 5 (*a*) to (*c*).

The said arrangement is characterized by the use of roll electrodes and is called "external power supply type".

Reference is made to FIG. 5 (*a*) for the case of wire. Opposed roll electrodes R01 and R02, each consisting of rolls a and b with their circumferencial faces opposed to each other with a wire-feeding path L1 in between are disposed in a specified spacing.

Either one or both of the rolls (b in Figure) in the opposed electrodes R01 and R02 are connected to the power source E through a slider S.

The travelling wire W1 passes through the opposed rolls a and b in contact with their circumferential surfaces and resistance heating takes place between the opposed electrodes R01 and R02.

In a certain case, the power is fed from the sources E with three sets of opposed roll electrodes R01 to R03 being arranged as illustrated in FIG. 6 (*b*) whereas in another case, the different current values between the opposed roll electrodes R01, R02 and between the opposed roll electrodes R02,R03 permit the conduction of current to the wire W1.

In either of the apparatuses in the above FIG. 5 (*a*) and (*b*), heating voltage appears at the opposite ends of wire W1 within the heating zone and may result in leakage of the conducting current outside the heating zone through the travelling wire W1, thereby damaging other equipments or causing excessive heating of the wire W1 or exposing the operators in the vicinity to an unexpected hazard.

To prevent them from happening, annular current-limiting reactors CH of which annulus permit the wire W1 to travel therethrough have to be disposed on one or both sides of the feeding path L1 outside the heating zone.

Therefore, this kind of apparatus necessitates current-limiting reactor CH, thereby causing longer line of equipments, resulting in higher equipment as well as producing cost.

There is the type of external power source as is, disclosed in Japanese Utility Model No. 116064-80 which eliminates the current-limiting reactors CH, wherein three sets of the opposed roll electrodes R01 to R03 are disposed as illustrated in FIG. 5 (*c*) and one pole (−pole for DC) of a power supply E (AC or DC) is connected to the opposed roll electrodes R02 and other pole (+pole for DC) is connected to the opposed roll electrodes R01 and R03 while both or either one of the opposed roll electrodes R01 and R03 is grounded. In this arrangement, the currents between opposed electrodes being i11 and i12 as illustrated in the Figure, the current loads, each on opposed roll electrodes R01 and R03 is nearly one half the load on the opposed electrode R02 and being grounded, no voltage appears at the end of the heating zone, resulting in no current leaking outside the heating zone through the wire W1.

This type of arrangement has two shortcommings although succeeded in eliminating the current-limiting reactor CH;

The one is likely to develop sparking due to greater current load on the opposed roll electrodes R02, thereby resulting in a spark scar in the wire W1 or heavier wear of the said opposed roll electrode R02 than the other electrodes.

The another shortcoming is that an excessive or insufficient temperature as compared to a desired one prevails for some time from the start to the normal operation because, taking an example of the wire W1 being caused to travel in the arrow direction, the equivalence of the inherent resistance R11 of the wire W1 between the opposed roll electrodes R01, R02 to the inherent resistance of R12 in the wire W1 between the opposed roll electrodes R02, R03 when not heated, causes the current to flow in $i\ 12 > i\ 11$ at the start and in $i\ 12 < i\ 11$ at the normal operation, thus adversely affecting the quality or yield ratio due to an instability in heating from excess or insufficiency with regard to a desired temperature.

The another type as disclosed in Japanese Utility model No. 36,485-71 involves an apparatus for annealing and the like by direct resistance heating of the wire work-hardened in the process of drawing in order to facilitate another drawing into extra fine wire to use for strand made of copper, aluminum or the like at the workshop of the cable manufacturers or for preheating or the like by resistance heating of stranded or drawn wires in the process of plastic coating to the surface thereof.

The basic arrangement of the said apparatus is illustrated in FIG. 6(*a*).

This is called &he sheave type, characterized by forming of a loop of articles for heating by the conductive sheaves ES1 and ES2.

The said sheave ES1 is so disposed that the wire-feeding path L1 is tangential to the sheave ES1 and the Sheave ES2 being spaced in a given distance from the sheave ES1 also away from the said wire feeding path L1.

The wire W1 travels around once or twice along the path formed both by the parallel tangents ta and tb shared commonly by both sheaves ES1 as well as ES2 and by each outer half circumference thereof.

An annular transformer T1 connected to a power supply (not shown) is disposed on a given path, for instance, on the path ta.

The said transformer T1 when fed, induces the secondary current in the wire W1 on the path ta with the wire W1 on the path tb as retrace so that the wire is heated.

This type of apparatus can only be applied to a flexible wire W1 because wide strips even being flexible, for instance, in an arrangement as shown in FIG. 6 (*b*) in which the sheaves ES1, ES2 are replaced with wide conductive rolls ER1 and ER2, the strip W2 has contact with the circumferencial surface of the roll ER1 in double tandem, thus causing a torsion in the strip W2 to a variety of degree depending upon the width or flexibility of the strip W2, resulting in extreme difficulty of permitting the strip W2 to travel in close contact with each surface of rolls ER1 and ER2, resulting in almost impossible for the strip to travel in close contact when the rolls ER1 and ER2 are spaced in as far as several meters and the width of a strip W2 is as wide as 500 mm or so.

The sheave type has not been applied to the heating of strips W2 since improper contact of the strip W2 with each roll ER may resulting in uneven heating and develop sparking which may leave scar on the products. The said type requires insulations for the equipments because of the hazard of leaking of high voltage current through the devices with which the ungrounded sheave ES and wire W1 have contact, requiring grounding of either one of the sheaves ES1 or ES2 when a large current is fed to the transformer T1.

There is an apparatus which is a variation of the sheave type using a transformer T1 as is disclosed in British patent No. 718,835 for heating of strips. As the basic arrangement thereof is shown in FIG. 7, rolls Rs and Rt are disposed in the vessel y filled with molten metal, salt or the like A and a roll Ru is disposed above the vessel y with a transformer T located between rolls Rs and Ru on which the flexible strip W2 is caused to travel in the direction shown by the arrow.

The transformer T1, when fed, as molten metal, salt and the like A are conductive, induces current i to flow in the secondary circuit formed through molten metal, salt or the like A, thus heating the strip W2 located between rolls Rs and Rt.

In this type of apparatus, the roll Ru in high voltage when molten metal A is grounded as in the apparatus (shown in FIG. 6 (*b*) and the use of conductive liquid makes it hazardous to human health and unfavorable to the quality of the products because of strips being heated with the said conductive liquid attached thereon.

The said apparatus is of course not applicable to thick unflexible strips.

SUMMARY OF THE INVENTION

The object of the invention is to provide a continuous direct-resistance-heating apparatus whereby long-length strips such as wire, bar or other articles made of steel, non-ferrous or other conductive materials are heated with little leaking outside of the conducting current, eliminating current-limiting reactor and requiring no additional current-conducted roll, thus insuring safety and space saving.

The additional object of the invention is to provide a direct-resistance heating apparatus permitting continuous, efficient and uniform heating of long-length articles.

The other features and advantages of the invention will be appreciated in the following description with reference to the attached drawings.

BRIEF DESCRIPTION OF THE DRAWINGS

FIG. 1 (*b*) is a side view of the cross section taken on line X—X of FIG. 1(*a*) for long-length strips.

FIG. 2 (*b*) is a side view taken on line Y—Y of FIG. 2(*a*).

FIG. 2(*c*) is an electrical circuit in the apparatus of FIG. 2(*a*).

FIG. 6 (*b*) is a perspective view of the apparatus of conventional sheave type which is diver&ed to strip heating.

DETAILED DESCRIPTION OF PREFERRED EMBODIMENT

Figure 1A:
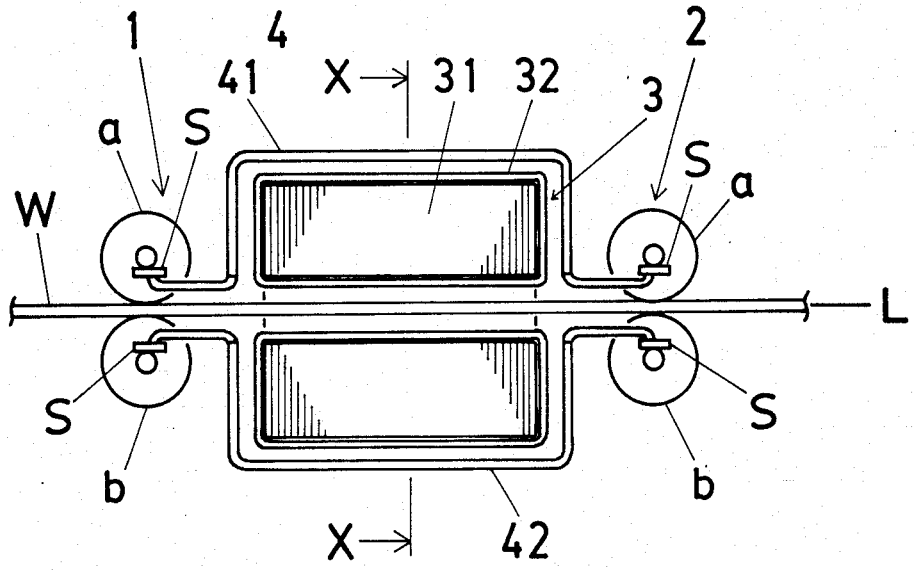
FIG. 1 (*a*) is a front view of an embodiment of the present invention.
Figure 1B:
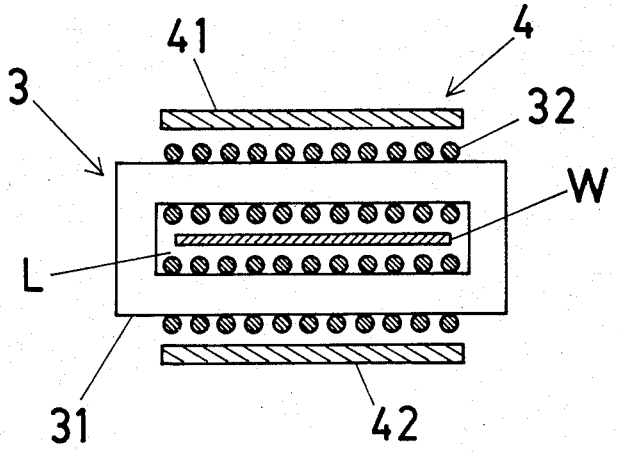

Reference is made to FIG. 1 (*a*) to (*b*) illustrating an embodiment of the present invention for heating of strip.

1 and 2 of FIG. 1(*a*) are the first and second roll electrodes respectively disposed in a specified spacing along a strip-feeding path L.

Each roll electrode 1,2 is so arranged that rolls a and b made from conductive materials with longer axial length than the width of the strip W to be heated are opposed to each other in the circumferencial surfaces length than the width of the strip W to be heated are opposed to each other in the circumferential surfaces thereof in a specified gap with the feeding path L in between, the gap which is so arranged to permit the strip W to travel in contact with the circumferential surfaces of the rolls a and b, sandwiched therebetween.

3 in the Figure is an annular transformer disposed between the first roll electrode 1 and the second roll electrode 2.

The said transformer 3 consists of an iron core 31 made of silicon steel sheets and the like having good property for the magnetic path, laminated to a specified thickness, for instance, formed in a rectangular annular form as is shown in FIG. 1(*b*) illustrating the cross section taken on line X—X and of primary coil 32 turned around the said iron core 31 from the outside to the inside and vice versa.

Inside the annular transformer 3, a strip-feeding path L is provided.

It is optimum for the said primary coil 32 to be turned so as not to cause the strip travelling through the path L to vibrate by electro-magnetic machine force or in other words to maintain symmetry with respect to the strip-feeding path L, in order to offset the electro-magnetic machine force.

The both terminals of the said primary coil 32 are connected to a power supply not shown in the Figure. In the opposing location close to the said primary coil S2 on the outer periphery of transformer 3, conductive members 4 with a specified width and thickness made from good conductive materials such as copper and the like 41 and 42 are provided.

The conductive members 41 and 42 are symmetrical with respect to the strip-feeding path L and parallel thereto.

The conductive members 41 and 42 are bent along the end face of the transformer 3 and connected to the roll a and b in each roll electrode 1 and 2 through each slider S.

The above connecting method is an example. The both ends of conductive members 41 and 42 may be united to connect with either one of the roll in the each roll electrode only with the arrangement of the current flowed through the conductive members 41,42 being shunted evenly.

The location in which the slider S slides and contacts can be anywhere, not limited to around the rotary shaft as shown in the FIG. if electrical connection can be properly maintained.

While the heating temperatures of strip W varies according to the applications the water-cooled conduit as a primary coil 32 is used for higher hearing temperature to prevent it from burning by radiation from the heated strip W.

A secondary closed circuit is formed consisting of the first and second roll electrodes 1,2 on the secondary of the transformer 3, of the strip to be heated W located between both roll electrodes 1,2 in the circuit connecting between the said first and second roll electrodes and having the resistance R1, of the sliders S, each of which slides and is in contact with each roll electrode respectively, of the conductive member 4 in the circuit connecting the said one slider S with the other S and having the resistance R2.

R1 in the closed circuit on the said secondary represents the equivalent resistance of the strip to be heated W and R2 that of the conductive member 4 respectively.

The article to be heated W has relatively higher electrical resistance and the conductive member 4 has any dimension including cross-sectional area so that the relation between the resistance R1 of the strip W and the resistance R2 of the conductive member 4 can easily be set to give $$R1 >> R2.$$

In the above apparatus, a closed circuit is formed with the conductive member 4, in sufficiently low electrical resistance as retrace of the current, which is disposed in parallel and symmetry with respect to the strip feeding path L on the periphery of the transformer 3 so that the current conducted through the strip W as a circuit having much higher resistance than the conductive member 4 heats the said strip W very efficiently.

The arrangement of the conductive member 4 which is a retrace, close to the primary coil 32 and in parallel and symmetry with respect to the feeding path L permits a lower secondary impedance than the primary, thereby reduces the voltage variations.

The transformer 3 is disposed between the first and second roll electrodes 1,2 with the strip W having sufficient resistance as the secondary so that the supply voltage is nearly consumed as load current for heating of the strip W located between the roll electrodes 1 and 2, with no load voltage disappeared, resulting in little leaking outside. Where U' is the voltage appeared outside and U is no-load voltage;

$$\text{given by } U' = \frac{R2}{R1 + R2} \times U$$

and $R1 >> R2$ leads to the above function.

Figure 6A:
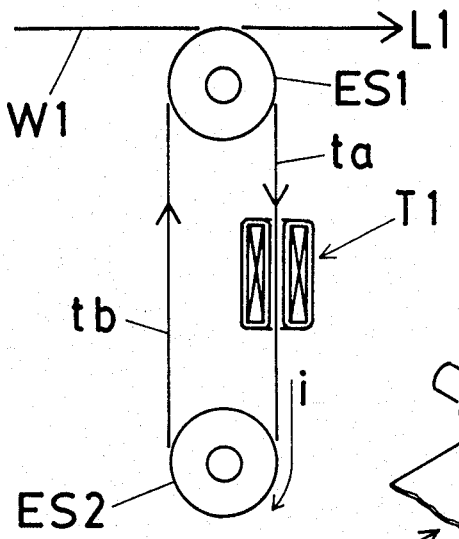
FIG. 6 (*a*) is a front view of wire-heating apparatus of conventional sheave type.
Figure 6B:
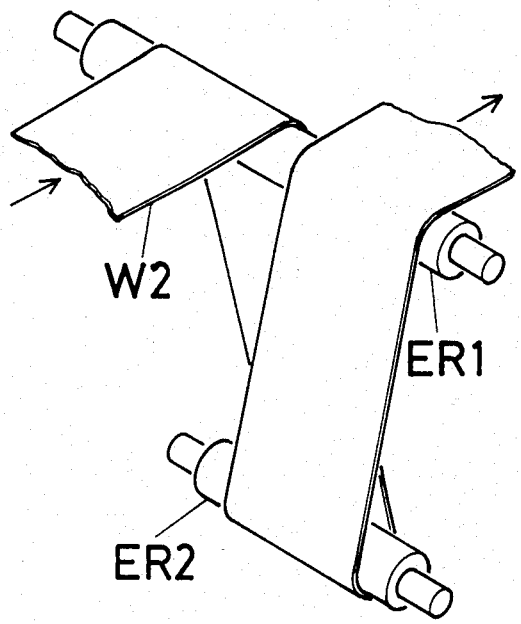
Figure 7:
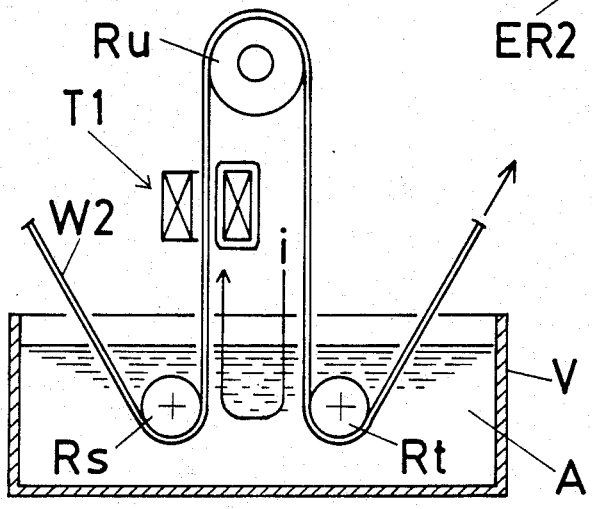
FIG. 7 is a front view of conventional direct-resistance heating apparatus for strip heating using a transformer.

Reference is made to the difference of the present invention from the conventional sheave type as shown in FIG. 6 (*a*) or the conventional strip heating apparatus provided with a transformer as shown in FIG. 7.

In the conventional sheave type or the like, the wire W1 travels along the paths ta and tb respectively so that the resistances of ta and tb are identical and not entire supply voltage is consumed for heating of wire W1, thus the voltage applied to the sheave ES2 is one-half to one-third the voltage of the sheave ES1 when the current i in FIG. 6 flows in the arrow direction, the same relationship being applied to that between the roll Ru and the molten metal or salt A in FIG. 7.

On the other hand, in the present invention, the supply voltage as described above is nearly consumed up as &he load current for heating the strip located between the roll electrodes 1,2 and no-load voltage disappears, what makes the present invention widely different from the sheave type.

Figure 2A:
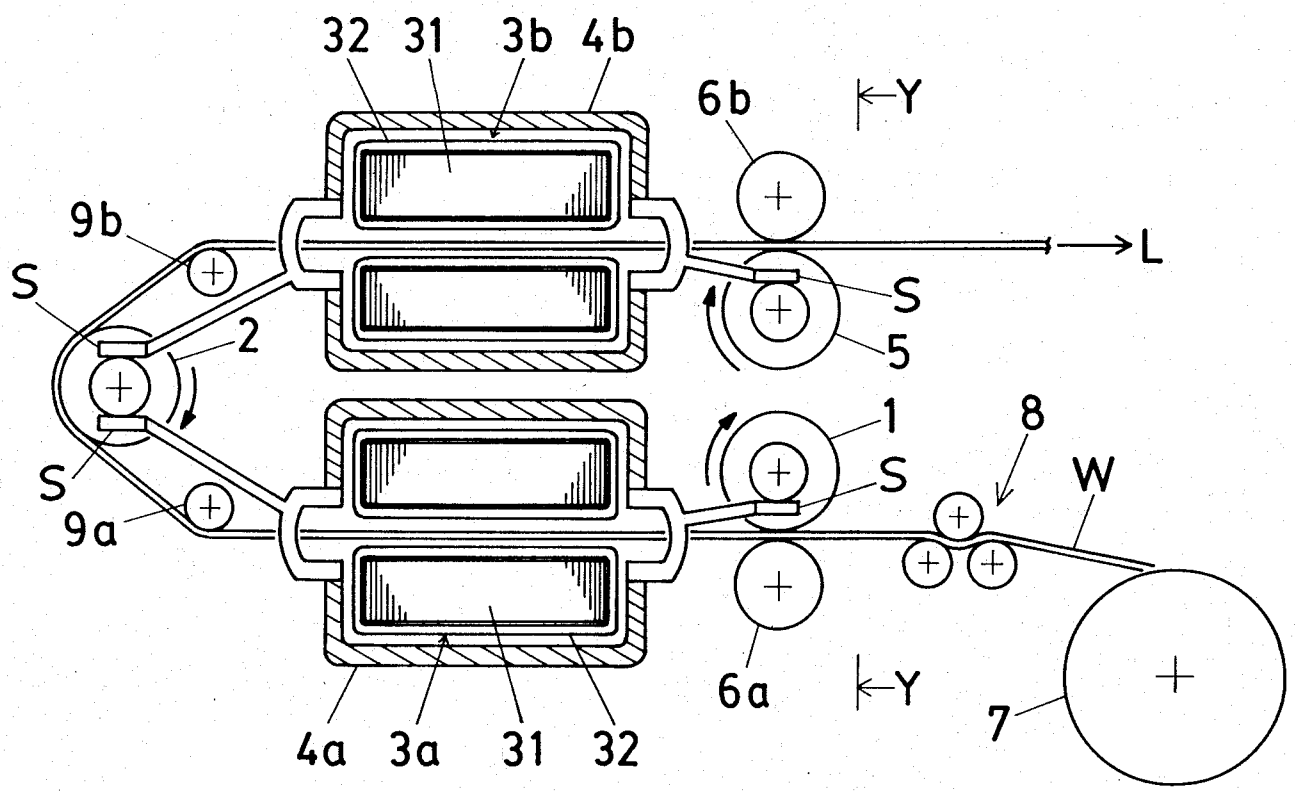
FIG. 2(*a*) is a front view of the apparatus differently embodying the present invention.
Figure 2B:
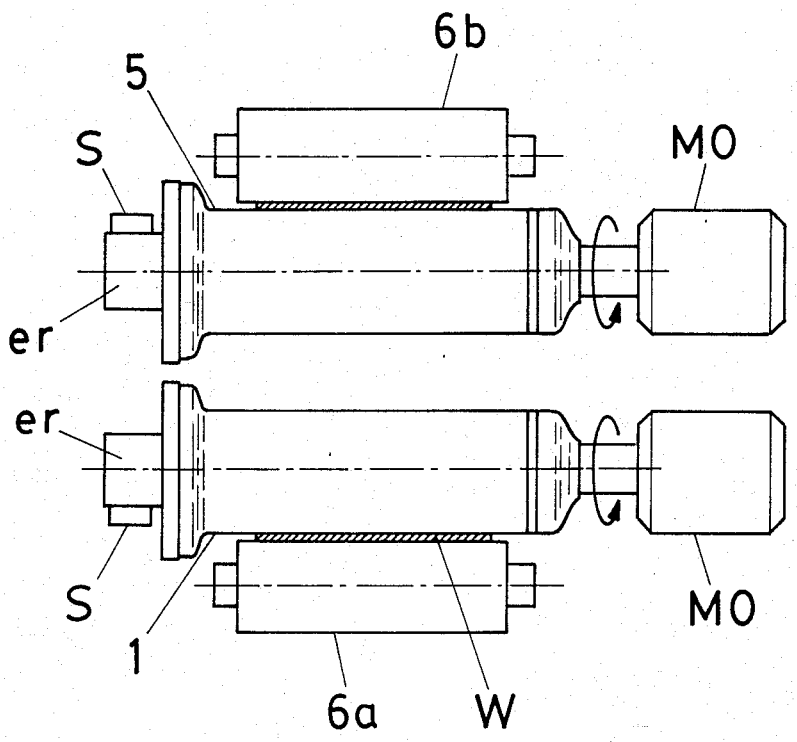
Figure 2C:
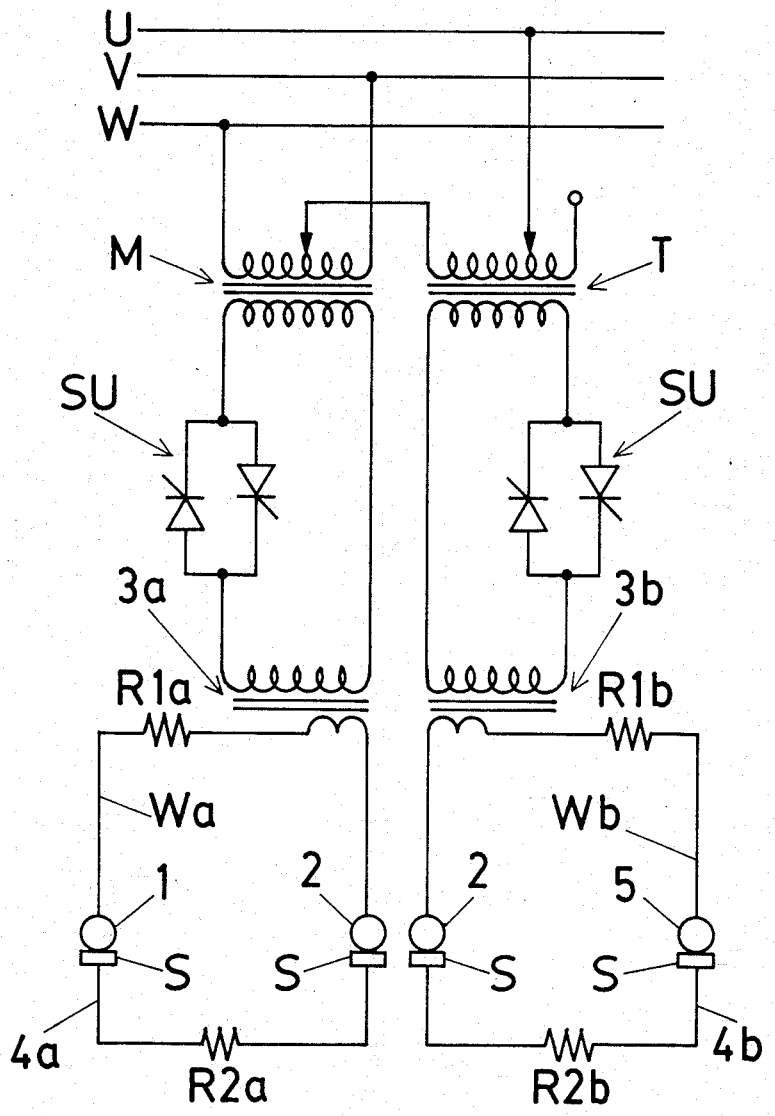

Another enlarged embodyments of the invention are illustrated in FIGS. 2 (*a*) to (*c*).

The said apparatuses are applicable, for instance, to flexible strips for their heating.

FIG. 2 (*a*) is a front view of the apparatus embodying the present invention wherein 1,2 and 5 are the first, the second and the third electrode respectively, 6(*a*) and 6(*b*) are auxiliary rolls respectively, 3*a* and 3*b* are the first and second annular transformers, 4*a* and 4*b* are conductive members disposed closely to the peripheries of each of the above transformers 3*a* and 3*b*, 7 is an uncoiler around which the strip W is wound, 8 is straightening rolls, 9*a* and 9*b* are idler rolls. Each of the above roll electrodes 1,2 and 5 is disposed in location as shown in the Figure in a specified spacing along the strip(W)-feeding path L shaped like U to form a processing line.

Each electrode 1,2 and 5 is rotated in the arrow direction at a given rotational speed by a driving source MO as shown in FIG. 2(*b*).

The above given rotational speed is a speed at which the circumferencial speeds of each roll electrode 1,2 and 5 are fully synchronized.

Power receivers er are provided at the opposite side of the above drive source MO on the driven shaft, which have contact with a slider S connected to the conductive member 4.

The above auxiliary rolls 6*a*, 6*b*, freely rotatable, each are opposingly arranged in a given gap from each roll electrodes 1,5 wherein for instance the auxiliary roll 6*a* employs hard rubber and the like for its roll because of the strips being still in lower temperature and the auxiliary roll 6*b* is ceramic coated because of the strips being heated.

The above gap is in such a setting as to permit the strips W to travel along the peripheral surface of each electrode keeping in close contact therewith. The straightening rolls 8 straighten the strips w coiled around uncoiler 7.

Idler rolls 9*a* and 9*b* cause the travelling strips w tense in order to permit it to travel along within a given arc on the periphery of the second roll electrode 2 in close contact therewith.

The construction and arrangement of each electrode 1,2 and 5 and of each conductive member 4*a*, 4*b* are the same with the above embodiment of the apparatus with only difference of each conductive member 4*a*, 4*b* connected to the second roll electrode 2 respectively through the slider S.

In the above arrangement, the strip W uncoiled from the uncoiler 5 travels along in close contact with the first electrode 1 via the straightening rolls 8 through the annular first transformer 3*a*, advances toward the second transformer 3*b* after having turned around a given range of the peripheral surface of the second roll electrode 2 in close contact therewith, keep travelling in close contact with the third roll electrode 5 after having passed through the said annular second transformer 3*b*.

The electrical circuit configuration in the said apparatus is shown in FIG. 2(*c*) wherein M and T are single-phase transformers respectively of which primary is connected to a three phase power source in the Scott connection, with the secondary of the transformer M being connected to the first transformer 3*a* and the secondary of the transformer T to the second transformer 3*b* through the power controlling switch SU.

The secondary of the above first transformer 3*a* is a closed circuit formed by a travelling a trip Wa located between the first and second roll electrode 1,2 and by a conductive member 4*a* located between sliders S and S connected respectively to the first and second roll electrode 1,2 with R1*a* representing the equivalent resistance of the strip Wa, and R2*a* that of the conductive member 4*a* respectively.

The secondary of the said second transformer 3*b* is a closed circuit formed by a travelling strip Wb located between the second and third roll electrode 2,5 and by a conductive member 4*b* located between sliders S and S connected respectively to the second and third roll electrode 2,5 with R1*b* representing the equivalent resistance of the strip Wb, and R2*b* that of the conductive member 4*b* respectively.

The said apparatus has in addition to the functions pertaining to the apparatus shown in FIG. 1 another advantage of resulting in no imbalance in three-phase voltage due to the arrangement to feed the three-phase power source from the both single-phase transformers in the Scott connection, thus eliminating a balancer requiring ingenuity to use, while permitting to arrange three-phase load very easily.

Figure 3:
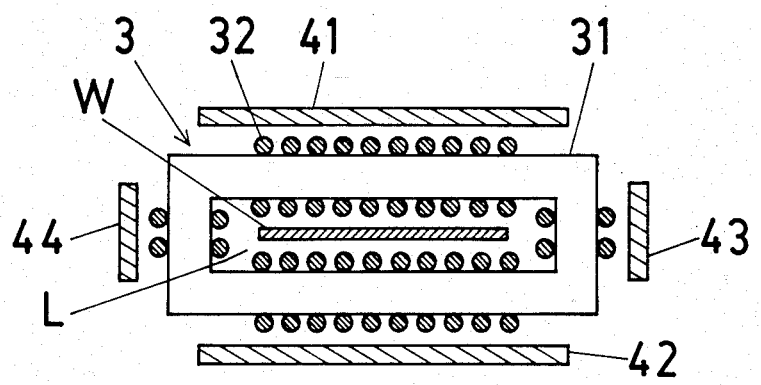
FIG. 3 is a cross section illustrating embodiment of the transformer used in the present invention.

In the transformer 3 in the present invention the primary coil 32 may be wound up and down the iron core 31 and on the right and left side of the annulus as shown in FIG. 3.

In this case, the conductive members 4 are disposed up and down, right and left of the core like 41 to 44 and so arranged as to maintain symmetry with respect to the feeding path L.

Figure 4A:
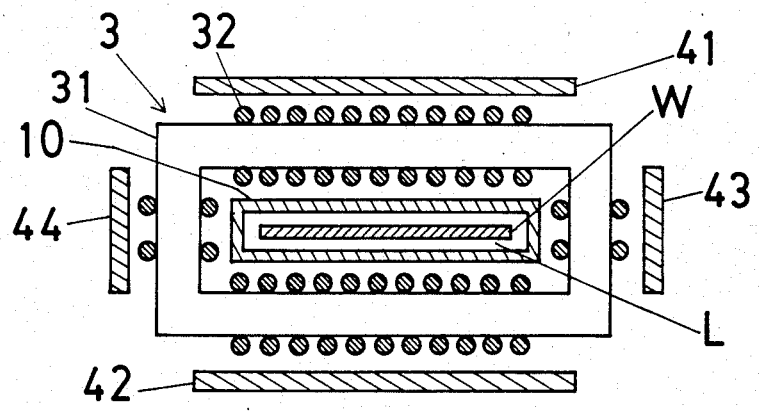
FIG. 4 (*a*) as well as (*b*) are cross sections of another embodiment of the transformer used in the present invention.
Figure 4B:
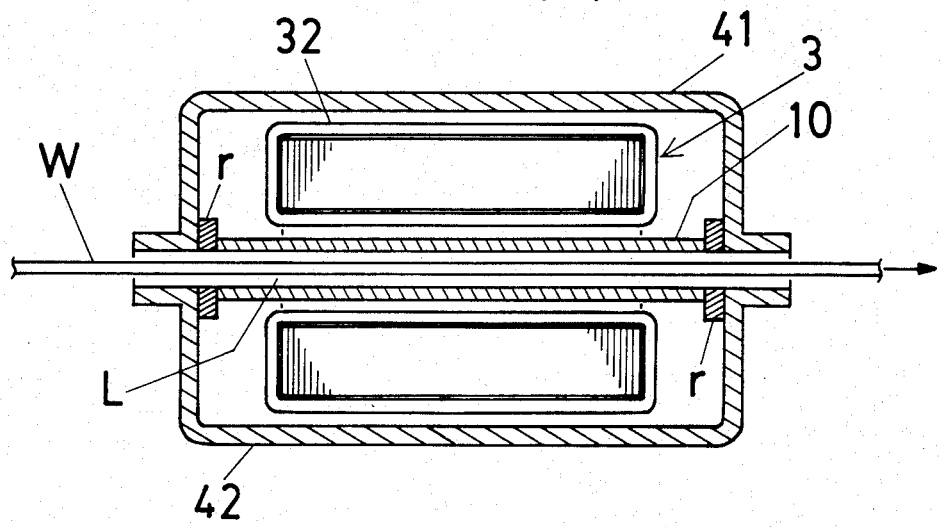
Figure 5A:
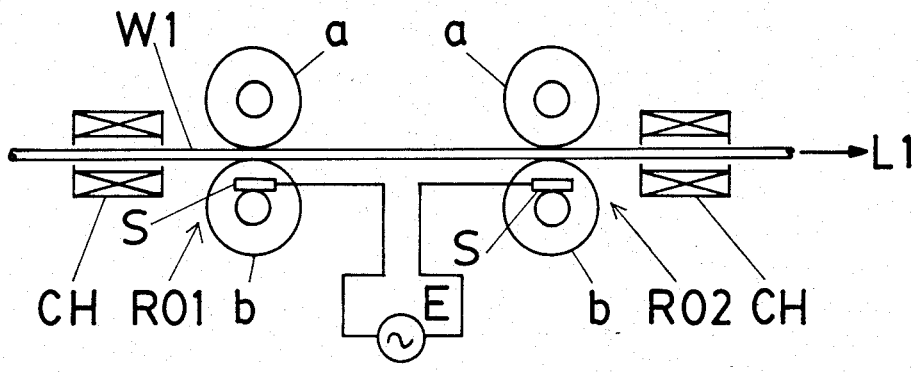
FIGS. 5 (*a*) to (*c*) are front views of conventional direct resistance-heating apparatus of external power supply type respectively.
Figure 5B:
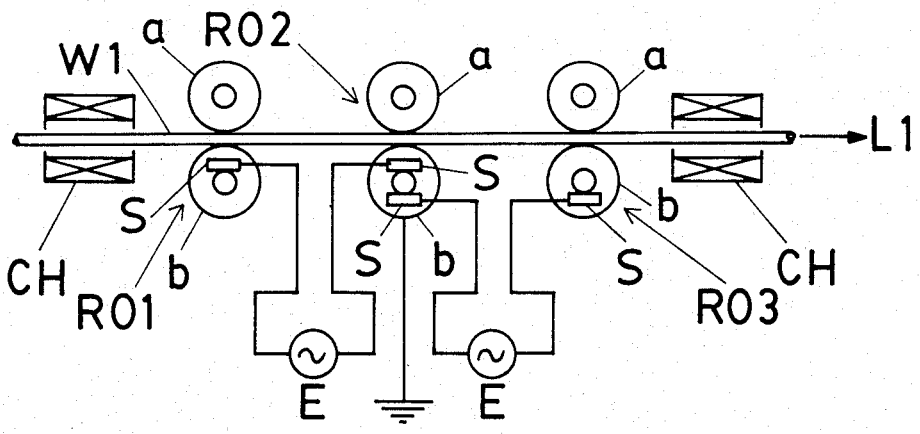
Figure 5C:
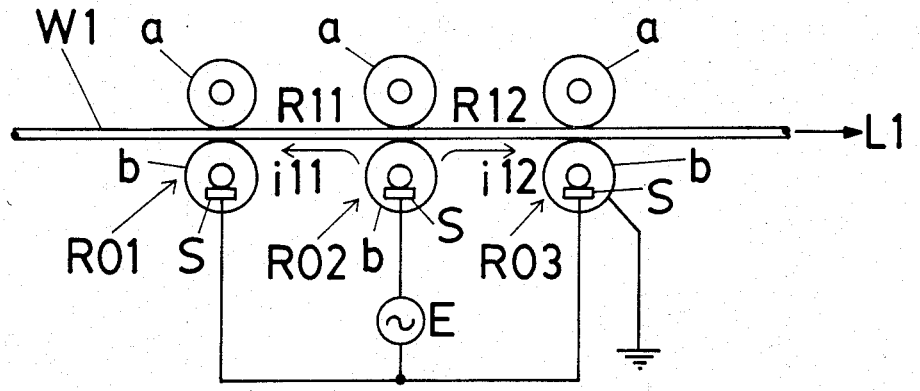

In some cases, the transformer 3 adopts such structures as shown in FIG. 4 (*a*) and (*b*) wherein 10 is a cylindrical body, with such cross section as enclosing a travelling strip W along the feeding path L through the annulus, which is held by the conductive members 4 through insulators r.

In the said arrangement, oxygen shortage within the cylinder 10 prevents the heated strips W from oxidation.

Filling the cylinder 10 with an inert gas provides more thorough prevention of oxidation, preventing sparking between the strip W and the electrode from being developed due to the surface oxidation in the strip W, thus contributing to both high quality assurance and prolonged life of &he electrode.

The present invention is not limited to the methods disclosed above wherein the arrangement of causing the strip W to travel in close contact with each electrode has been described in reference to FIG. 1(*a*) using opposed roll electrodes 1,2 consisting of rolls a,b and to the use of auxiliary rolls 6*a*, 6*b* in FIG. 2 (*a*) or to the method of causing the strip W to tense by means of idler rolls 9*a* and 9*b* for smooth turning of the strip W round a specified arc, in close contact therewith, on the circumferential surface of the second roll electrode 2.

As a matter of course the opposed electrodes 1 and 2 in FIG. 1(*a*) may be used as a roll electrode in FIG. 2 (*a*), or reversely auxiliary rolls 6 in FIG. 2(*a*) may be replaced with the opposed roll electrodes 1,2 in FIG. 1.

The above embodiment of the invention relates to flexible strips W and the feeding path L shaped like U. However, linear arrangement may of course be used when applied to non flexible strips or to flexible strips with enough room for installation.

While the above drawings and descriptions are concerned mainly with heating of strips, the present invention is also applicable to heating of long-length articles such as wire, bar or continuous pipe or shape and the like wherein the transformer is in annular shape to permit unhindered travelling of the articles for heating with the circumferencial surface configuration of the roll electrode is such as to allow it to energize the article for heating in close contact therewith with the conductive members being provided according to the above requirements, thereby producing the similar workings and effects to the above embodiments.

The direct-resistance-heating apparatus of the present invention provides uniform heating of the long-length articles such as strip, wire, bar and the like being fed continuously, serving a great deal for improvement in the quality of the products accompanied by the exceedingly high heating efficiency.

The said apparatus has additional advantages of insuring safety by little leakage outside owing to extremely low voltage on the secondary whereas the conventional sheave type involves greater hazard as the insulated construction of the sheave requires higher voltage.

Further advantages of the present invention are elimination of current-limiting reactor which has been indispensable for the conventional external power source type, thus permitting smaller size of the apparatus, thereby realizing shorter processing line, thus enabling easy insertions and installation of the equipment between the apparatuses in the manufacturing line without requiring insulation for the other equipments in the line as well as for the apparatus of the present invention.

Furthermore, the adoption of the apparatus in the above embodiment 2 has in addition to the above, the effect of readily preventing imbalance of the three-phase voltage, eliminating a balancer, achieving further smaller size of the apparatus and cost reducing. As described in the above, the present invention has such outstanding advantages and extensive applications.

What is claimed is:

1. An apparatus for direct-resistance heating of long-length articles fed continuously being characterized by comprising the first and second roll electrodes disposed in a specified spacing along a feeding path, an annular transformer being disposed between the said first and second roll electrodes and conductive members being disposed closely along the periphery in the longitudinal direction of the said transformer, each of the said roll electrodes being such as to permit the long-length article to travel along the peripheral surface thereof in close contact therewith, the above transformer being annular through which the feeding path is provided and having a specified length with the primary coil of the transformer being wound in symmetry with respect to the feeding path, the said conductive members being in parallel and symmetry with respect to the feeding path and opposed to the said primary coil with the opposite ends thereof being connected to each roll electrode through a slider respectively, wherein the relation between the resistance R1 of the long-length article and the resistance R2 of the conductive member with respect to the conducting current is so set as to give $$R1 >> R2.$$

2. An apparatus for direct-resistance heating of long-length articles continuously fed being characterized by consisting of the first, second and third roll electrodes disposed in a specified spacing along the long-length-article-feeding path, of the annular first and second transformers disposed between the said first and second roll electrodes and between the second and third roll electrodes respectively, and of the conductive members disposed closely in longitudinal direction of each transformer along the periphery of the first and second transformers respectively, the above each roll electrode being such as to permit traveling of long-length articles in close contact with the periphery thereof, the above first and second transformers each being annular through which a long-length-article-feeding path being provided with a specified length, the primary coil of each transformer being wound in symmetry with respect to the feeding path, fed from the both single-phase transformers in the Scott connection to a three-phase power supply, each of the above conductive members being opposed to the primary coil in parallel and symmetry with respect to the feeding path with the opposite ends thereof being connected to the roll electrode next thereto through a slider, wherein the relation between resistance R1 of the long-length article and the resistance R2 of each conductive member with respect to the conducting current being so set as to give $$R1 >> R2.$$

3. The apparatus of claim 1, wherein long-length articles contain strips, wires, bars and the like being capable of continuously being fed and also capable of travelling in close contact with the roll electrodes.

4. The apparatus of claim 1 travelling of a long-length article in close contact with the roll electrodes is made possible by opposed roll electrodes which hold the long-length article between the opposing peripheral surfaces.

5. The apparatus of claim 1 travelling of a long-length article in close contact with the roll electrodes is made possible by auxiliary roll being opposed to the roll electrode, which forces the long length article against the roll electrode.

6. The apparatus of claim 1 travelling of a long-length article in close contact with a roll electrode is made possible by causing the long-length article to tense while it is caused to travel with one side of the surface thereof in contact with the peripheral surface at a specified arc range.

7. The apparatus of claim 1 the transformer contains in the annulus thereof a cylindrical body in such cross section as encircling a long-length article.

8. The apparatus of claim 1 the cylindrical body disposed in the annulus of the transformer is introduced or filled with an inert gas.

9. The apparatus of claim 2, wherein long-length articles contain strips, wires, bars and the like being capable of continuously being fed and also capable of travelling in close contact with the roll electrodes.

10. The apparatus of claim 2, wherein travelling of a long-length article in close contact with the roll electrodes is made possible by opposed roll electrodes which hold the long-length article between the opposing peripheral surfaces.

11. The apparatus of claim 2, wherein travelling of a long-length article in close contact with the roll electrodes is made possible by auxiliary roll being opposed to the roll electrode, which forces the long-length article against the roll electrode.

12. The apparatus of claim 2, wherein travelling of a long-length article in close contact with a roll electrode is made possible by causing the long-length article to tense while it is caused to travel with one side of the surface thereof in contact with the peripheral surface at a specified arc range.

13. The apparatus of claim 2, wherein the transformer contains in the annulus thereof a cylindrical body in such cross section as encircling a long-length article.

14. The apparatus of claim 13, wherein the cylindrical body disposed in the annulus of the transformer is introduced or filled with an inert-gas.

* * * * *